US006485606B2

(12) United States Patent
Boss

(10) Patent No.: US 6,485,606 B2
(45) Date of Patent: Nov. 26, 2002

(54) APPARATUS FOR BINDING SHEET MEDIA

(75) Inventor: Roland Boss, Guadalajara (MX)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/880,544

(22) Filed: Jun. 12, 2001

(65) Prior Publication Data

US 2001/0042599 A1 Nov. 22, 2001

Related U.S. Application Data

(62) Division of application No. 09/482,124, filed on Jan. 11, 2001.

(51) Int. Cl.[7] ..... B30B 15/06; B30B 15/34

(52) U.S. Cl. ..... 156/583.1; 156/311; 156/228; 156/282; 412/8; 412/33; 412/900; 412/902; 412/22

(58) Field of Search ..... 156/580–583, 156/91, 277, 290–291, 384–386, 311, 908, 228, 282, 324, 498, 367–368; 412/8, 33, 900, 902, 22

(56) References Cited

U.S. PATENT DOCUMENTS

| | | | | | |
|---|---|---|---|---|---|
| 3,607,545 | A | * | 9/1971 | Parsons et al. | 156/311 |
| 3,793,016 | A | * | 2/1974 | Eichorn | 118/638 |
| 3,794,550 | A | | 2/1974 | Taillie | 161/147 |
| 3,926,713 | A | * | 12/1975 | Lowe et al. | 156/461 |
| 4,071,388 | A | * | 1/1978 | Usui et al. | 156/157 |
| 4,343,673 | A | | 8/1982 | Smith, Jr. et al. | 156/583.4 |
| 4,398,986 | A | | 8/1983 | Smith, Jr. et al. | 156/290 |
| 4,790,901 | A | * | 12/1988 | Kettelhoit et al. | 100/320 |
| 5,014,092 | A | | 5/1991 | Kubo et al. | 355/324 |
| 5,399,223 | A | * | 3/1995 | Vogt | 156/285 |
| 5,531,429 | A | | 7/1996 | Clark | 270/58.11 |

* cited by examiner

*Primary Examiner*—Michael W. Ball
*Assistant Examiner*—Jessica Rossi

(57) ABSTRACT

A method and apparatus for binding documents by individually binding each media sheet to previously bound media sheets using imaging material as the binding material.

1 Claim, 8 Drawing Sheets

APPARATUS FOR BINDING SHEET MEDIA

CROSS REFERENCE TO RELATED APPLICATION

This is a divisional of copending application Ser. No. 09/482,124 filed on Jan. 11,2001.

FIELD OF THE INVENTION

This invention relates to an apparatus and method for binding media sheets. More particularly, the invention relates to an apparatus and method for producing a bound document from a plurality of media sheets by individually binding each media sheet to previously bound media sheets.

BACKGROUND OF THE INVENTION

Current devices and methods for printing and binding media sheets involve printing the desired document on a plurality of media sheets, assembling the media sheets into a stack, and separately stapling, clamping, gluing and/or sewing the stack. In addition to imaging material used to print the document, each of these binding methods require separate binding materials, increasing the cost and complexity of binding. Techniques for binding media sheets using a common printing and binding material are known in the art. These techniques generally involve applying imaging material such as toner to defined binding regions on multiple sheets, assembling the media sheets into a stack, and reactivating the imaging material, causing the media sheets to adhere to one another. These known devices and methods, however, can consume significantly more time than producing an unbound document. Each involves printing the entire or a substantial portion of the desired document, then assembling and aligning the media sheets into a stack in preparation to be bound. Binding the stack of media sheets also entails applying sufficient heat to the binding region to reactivate the imaging material throughout multiple sheets or throughout the entire stack. Consequently, the thickness of the bound document is limited by the device's ability to adequately heat the binding regions throughout multiple sheets or the stack without damaging the media sheets.

SUMMARY OF THE INVENTION

The present invention is directed to a new method and apparatus for binding documents by individually binding each media sheet to previously bound media sheets using imaging material as the binding material. One method embodiment of the invention includes the acts of (1) applying imaging material to a binding region on a single media sheet and activating the imaging material, (2) collecting the sheet together with previously collected sheets in a stack, (3) reactivating the imaging material applied to the binding region of the sheet, and (4) repeating the acts of applying, collecting and reactivating for each sheet in the plurality of sheets to form the finished bound document. One apparatus embodiment of the invention includes a tray for collecting a plurality of media sheets, a heating element near the tray, and a press coupled to the heating element. The heating element is movable between a first position in which the heating element is separated from the media sheets and a second position in which the heating element contacts a media sheet. The press is operative for each sheet output to the tray to press the heating element against the binding region of the sheet to thereby apply pressure and heat to reactivate the imaging material and bind the sheet to the previously bound sheets in the stack.

DETAILED DESCRIPTION OF THE INVENTION

Figure 1:
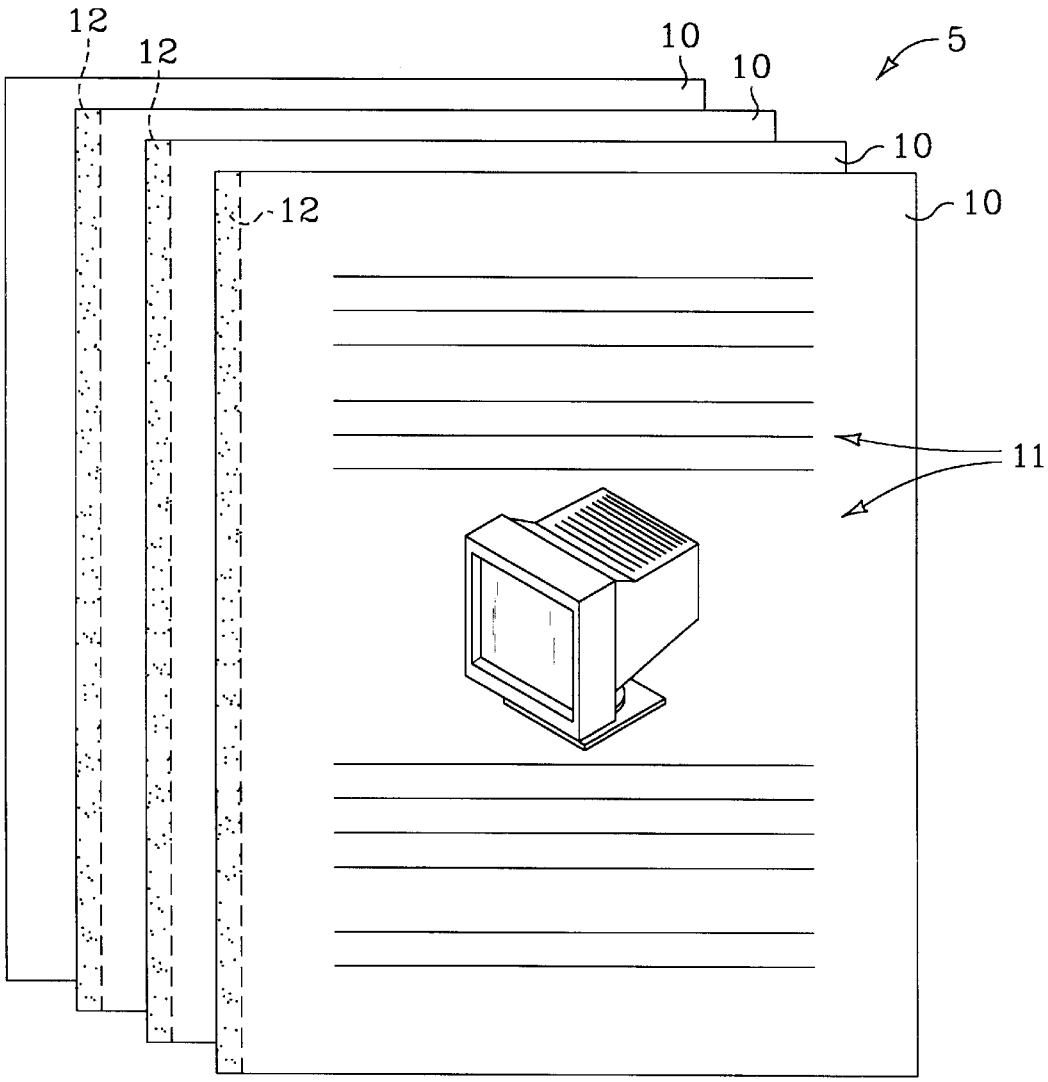
FIG. 1 is a plan view of multiple media sheets that will be bound in to a document showing the toner binding region along the left edge of each sheet.

FIG. 1 shows multiple media sheets used to form a document 5, each media sheet generally referenced as 10. Document 5 includes multiple print images 11. Each print image 11 represents a page of document 5 and may include text and/or graphics. Each media sheet 10 may have a print image 11 applied to one or both sides. For example, a ten page document, composed of ten print images, may be produced on five media sheets, one print image on each side. Each media sheet 10 also includes imaging material, such as toner, applied to one or more selected binding regions 12. Binding region 12 usually will be located along one edge of media sheet 10 on one or both sides. Preferably, binding region 12 is applied to only the bottom side of each sheet in which case it is not necessary to apply imaging material to a binding region on the first/bottom sheet. The dotted lines along binding regions 12 in the Figures indicate the imaging material has been applied to the bottom side of the sheet.

Figure 2:
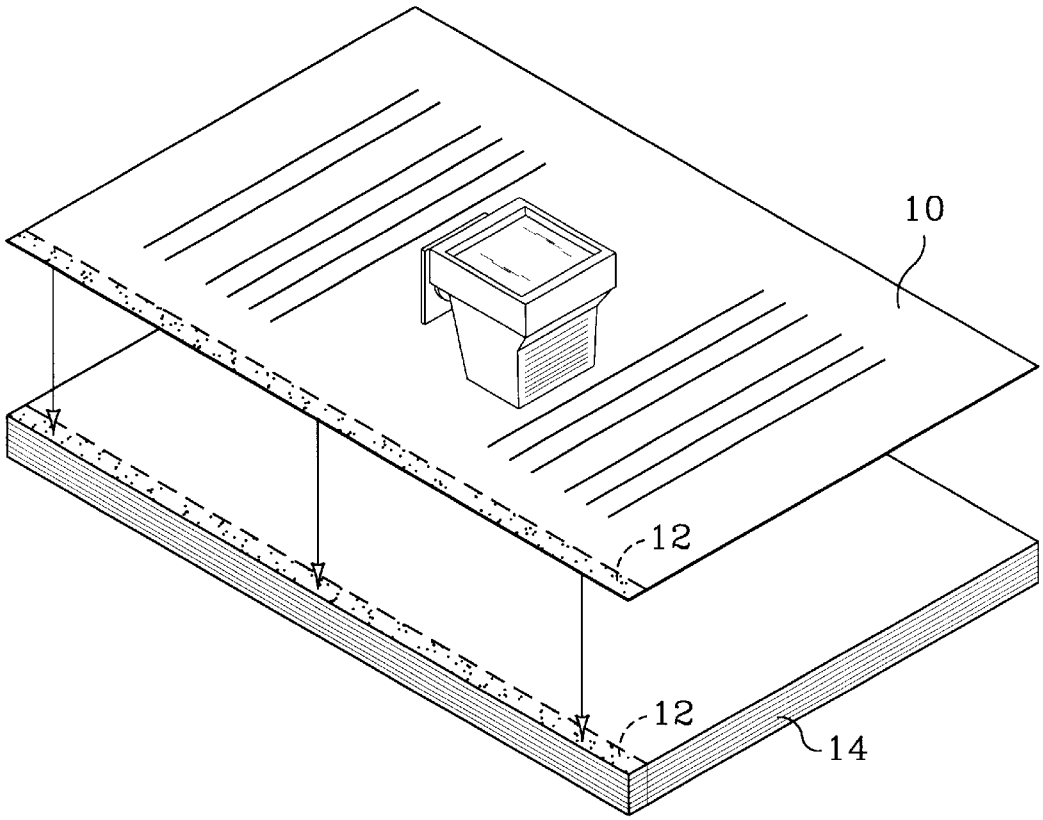
FIG. 2 is a perspective view of sheets being bound into a document showing a single sheet positioned over a stack of sheets that have already been bound together.

Referring now to FIG. 2, document 5 is formed by individually binding each sheet 10 one after another to the stack 14. As each sheet 10 is output to the stack 14, binding region 12 is aligned with the binding region of the sheets in stack 14 and the imaging material applied to binding region 12 is reactivated to fuse and thereby bind sheet 10 to stack 14. The strength of the inter-sheet bond is a function of the type, area, density, and degree of reactivation of the imaging material applied to binding region 12 of each media sheet 10. By varying these parameters the inter-sheet bond can be made very strong to firmly bind the document or less strong to allow easy separation. It is expected that the imaging material will usually be reactivated by applying heat and pressure. A variety of other reactivation techniques that may be used are described in my copending application Ser. No. 09/320,060, titled Binding Sheet Media Using Imaging Material, which is incorporated herein by reference in its entirety. This may be accomplished by direct application of heat as described above, or ultrasound, magnetic energy, radio frequency energy and other forms of electromagnetic energy. It is possible to use toner which re-activates upon application of pressure. The toner used for binding may include magnetic ink or otherwise may have a quality of reacting to electromagnetic, optical or actinic energy (infrared, visible or ultraviolet). The ability to react to energy may be in the form of heat conversion or chemical reaction. The ability to react to energy enhances the ability of re-activating without burning the paper or otherwise damaging the sheets. Hence, pressing a heating element against the stack is just one structure that may be used to carry out the method of the invention.

Figure 3:
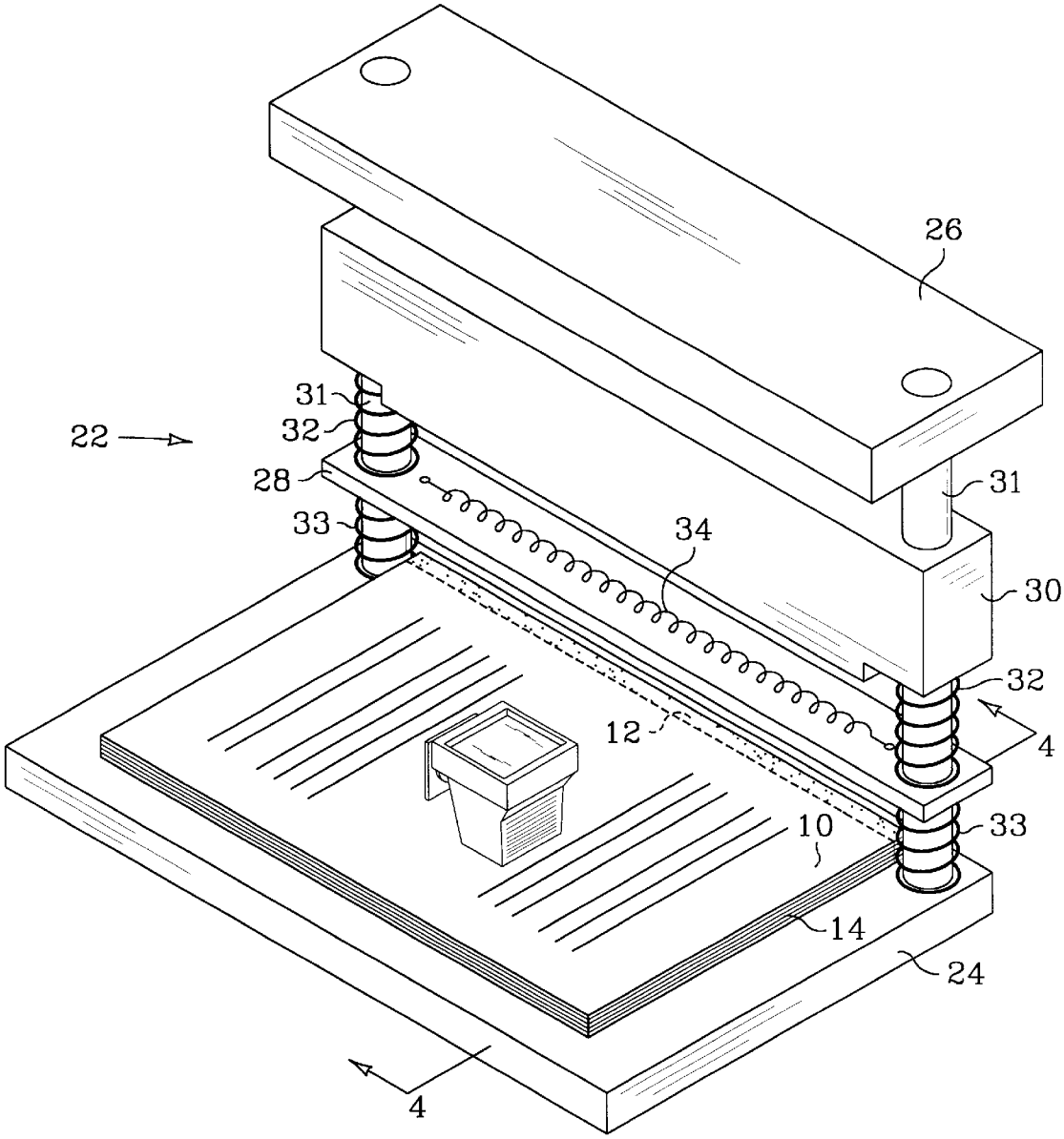
FIG. 3 is a perspective view of a binding device constructed according to one embodiment of the invention in which document is stacked horizontally and the binder uses a thermally dissipative heat sink.

FIG. 3 illustrates a binding apparatus 22 constructed according to one embodiment of the invention. Referring to FIG. 3, binding apparatus 22 includes a sheet collecting tray 24, press 26, heating member 28 and heat sink 30. Press 26, heating member 28 and heat sink 30 move up and down or back and forth along guide posts 31. Heating member 28 is biased away from the sheet collection area of tray 24 with, for example, compression springs 32 to provide adequate clearance for the document. Press 26 is operatively coupled to heating member 28 through heat sink 30 and a second pair of compression springs 33 positioned between heat sink 30 and heating member 28. Preferably, heat sink 30 will have a much greater effective thermal mass than heating member 28 and heating member 28 will be very thin to promote rapid heating and cooling. In this embodiment, heating member 28 includes an electrically resistive heating element 34. Heating member 28 is heated, for example, by electric current passing through a resistive element 34. The relatively large thermal mass of heat sink 30 may be achieved in a variety of ways. For example, heat may be dissipated passively through a large physical mass of thermally conductive material that dissipates heat by thermal conduction as it contacts heating member 28. Heat may be dissipated actively through a convection heat sink in which moving air is used to cool heating member 28. Or, heat may be dissipated through a material having a much lower electrical resistance that diverts electrical current from heating member 28. A combination of two more of these techniques might also be used. The relation of the heat capacities of heating member 28 and heat sink 30 can be optimized for the particular operating environment to help facilitate continuous operation of binder 22.

Figure 4A:
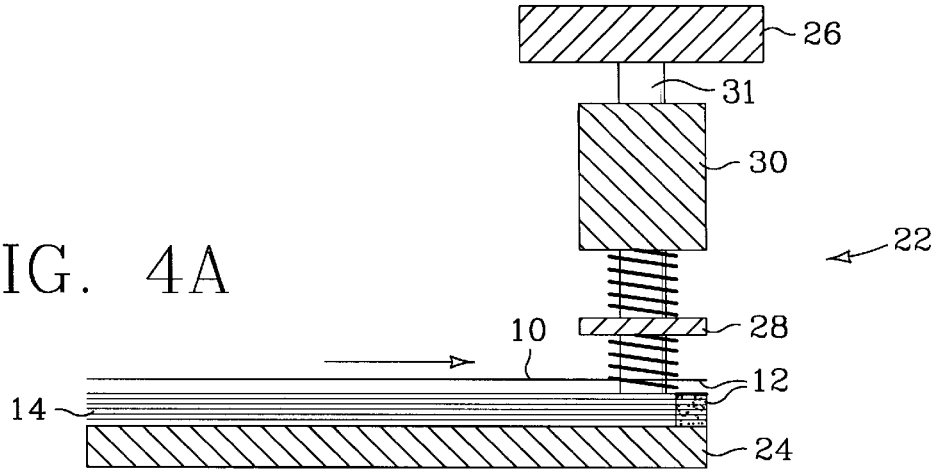
FIGS. 4A–4C are sequential cross section views of the binding device of FIG. 3 showing an individual media sheet being bound to a previously bound stack of sheets.
Figure 4B:
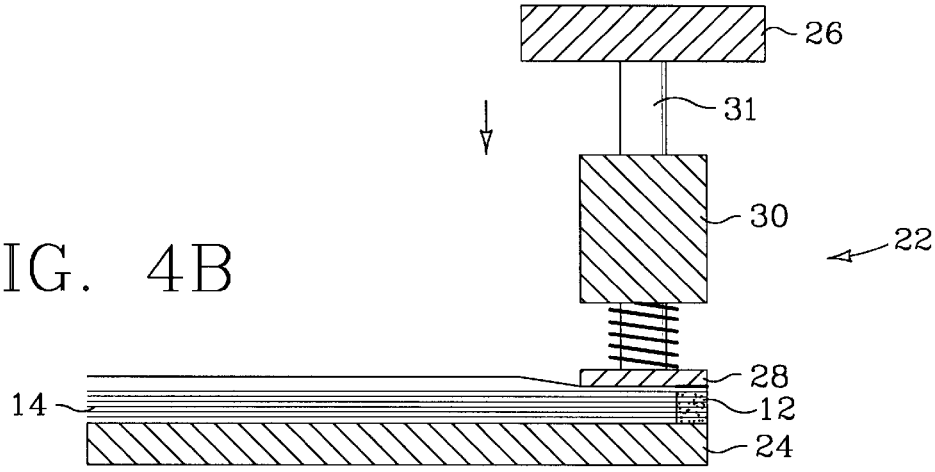
Figure 4C:
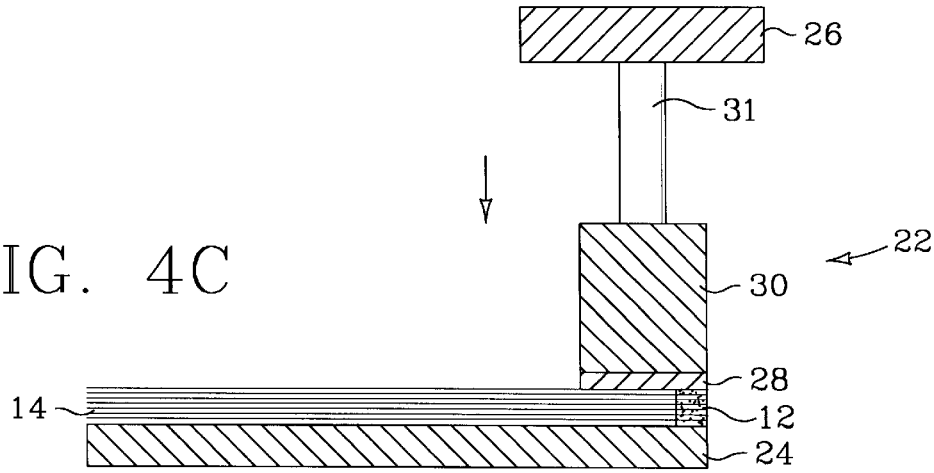

The operation of binder 22 will now be described with reference to the section view of binder 22 in FIGS. 4A–4C. Each sheet 10 is output from the printer, copier, fax machine or other image forming device into tray 24. Sheet 10 is aligned to the stack 14 as may be necessary or desirable using conventional techniques. As press 26 descends against heat sink 30, it overcomes the resistance of first biasing springs 32 and presses heating member 28 against top sheet 10 and stack 14 along binding region 12, as seen by comparing FIGS. 4A and 4B. The heat and pressure applied to binding region 12 of sheet 10 reactivates the imaging material (melts the toner) in region 12. As press 26 continues to descend, it overcomes the resistance of second biasing springs 33 and presses heat sink 30 into contact with heating member 28, as seen by comparing FIGS. 4B and 4C. The large comparatively cool thermal mass of heat sink 30 cools heating member 28, sheet 10 and stack 14. Press 26 is held momentarily in the fully descended position to maintain pressure on sheet 10 and stack 14 as the heating member 28 cools. The cooling combined with the continuing compression of media sheet 10 and stack 14 allows the reactivated imaging material (melted toner) to cure. As the pressure is released, biasing springs 32 and 33 return heating member 28 and heat sink 30 to their respective starting positions.

In the embodiment illustrated in FIGS. 3 and 4A–4C, heat sink 30 is a highly thermally conductive material such as an aluminum block or a forced air convection type heat exchanger. Heat sink 30 must be large enough to dissipate heat from heating member 28 throughout the binding operation. The size and thermal conductivity of heat sink 30 will depend on a variety of operating parameters for the particular printing system, including the speed of the printer (usually measured in pages output per minute), the maximum number of pages in the bound document, the characteristics of the toner or other imaging materials used to bind the pages and the availability of cooling air flow. Second springs 33 are stiffer than first springs 32 so that as press 26 descends heating member 28 is pressed against the stack 14 before heat sink 30 is pressed against heating member 28.

Figure 5A:
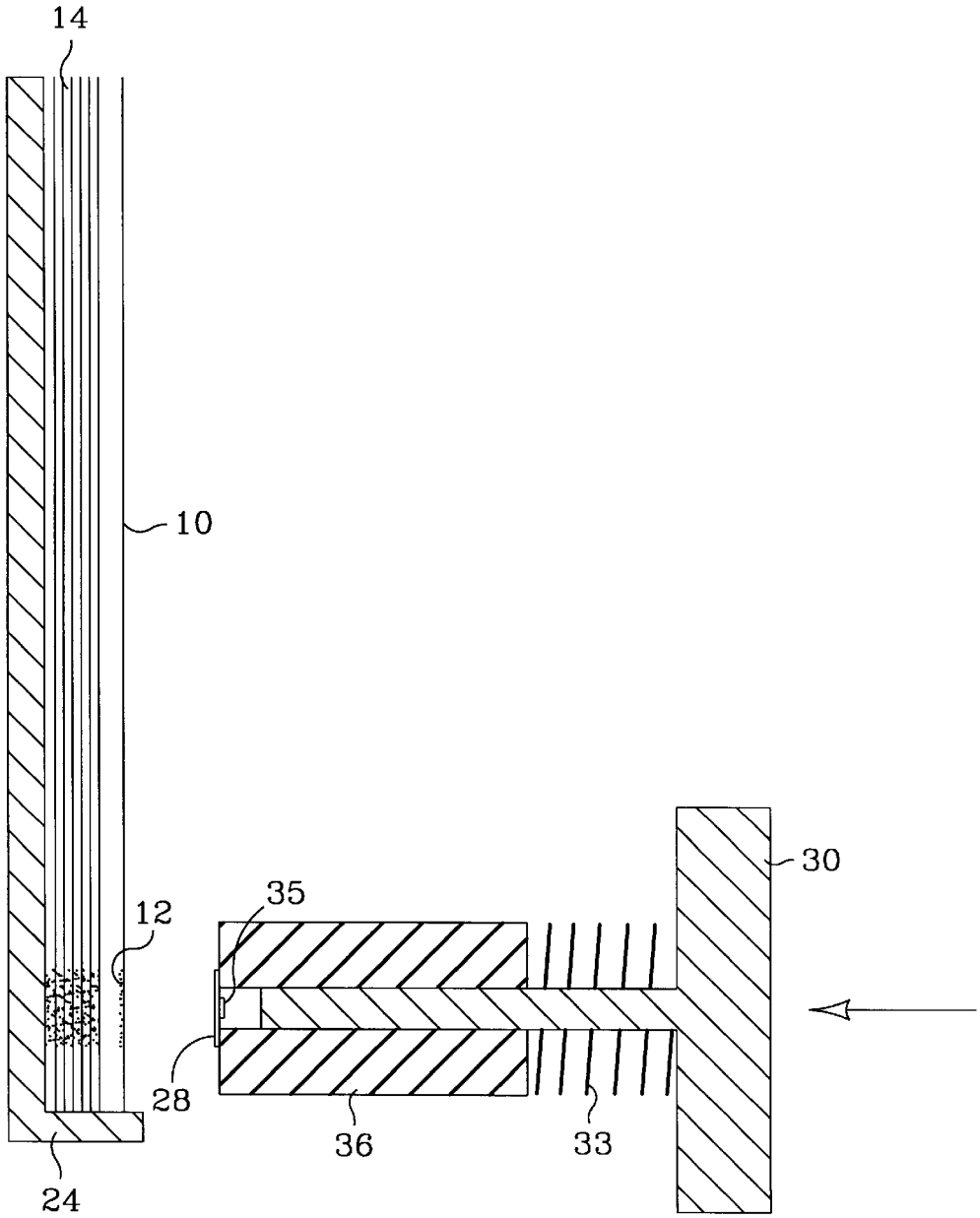
FIGS. 5A–5C are sequential cross section views of a binding device constructed according to a second embodiment of the invention in which the document is stacked vertically and the binder uses an electrically dissipative heat sink.
Figure 5B:
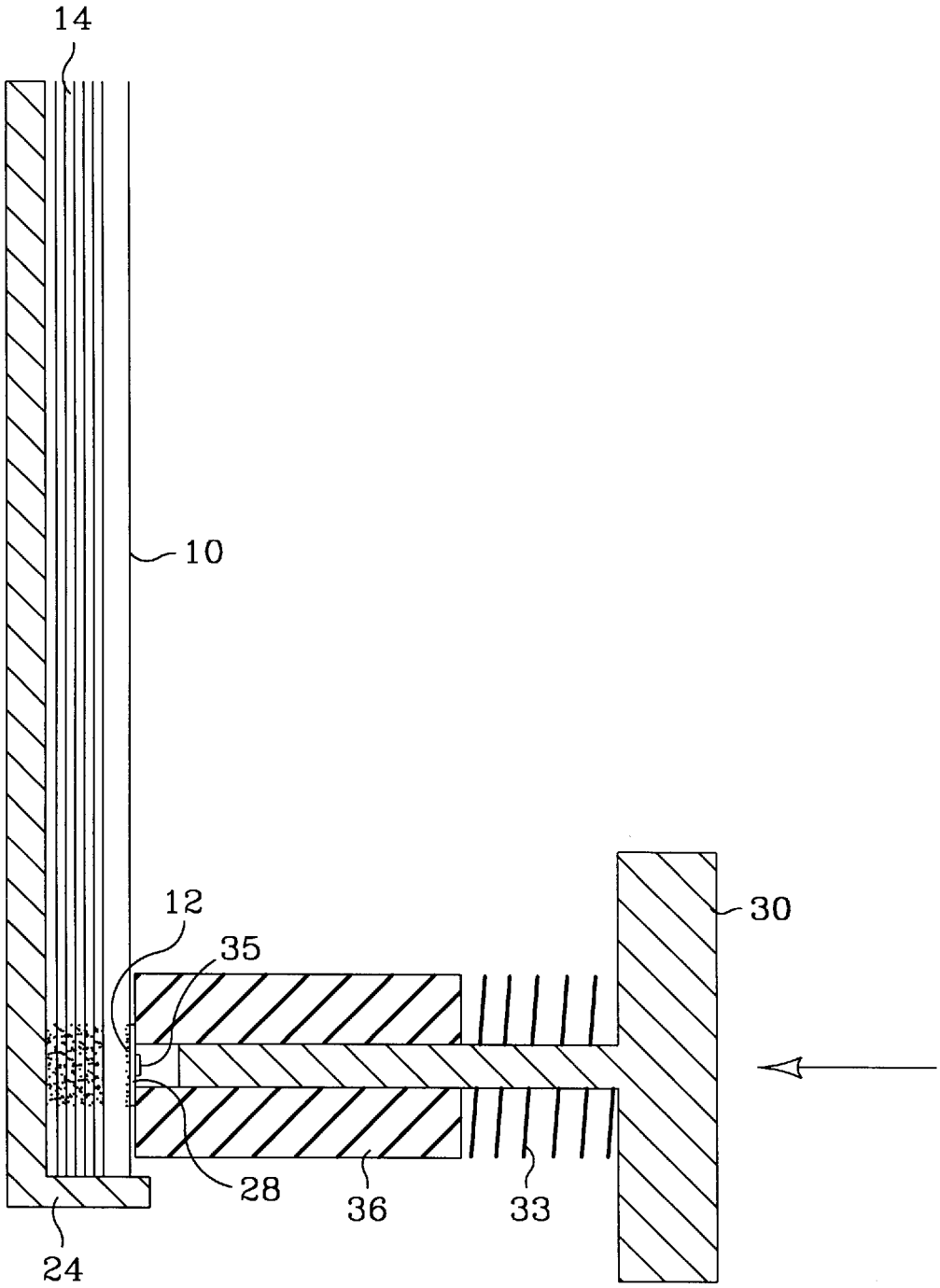
Figure 5C:
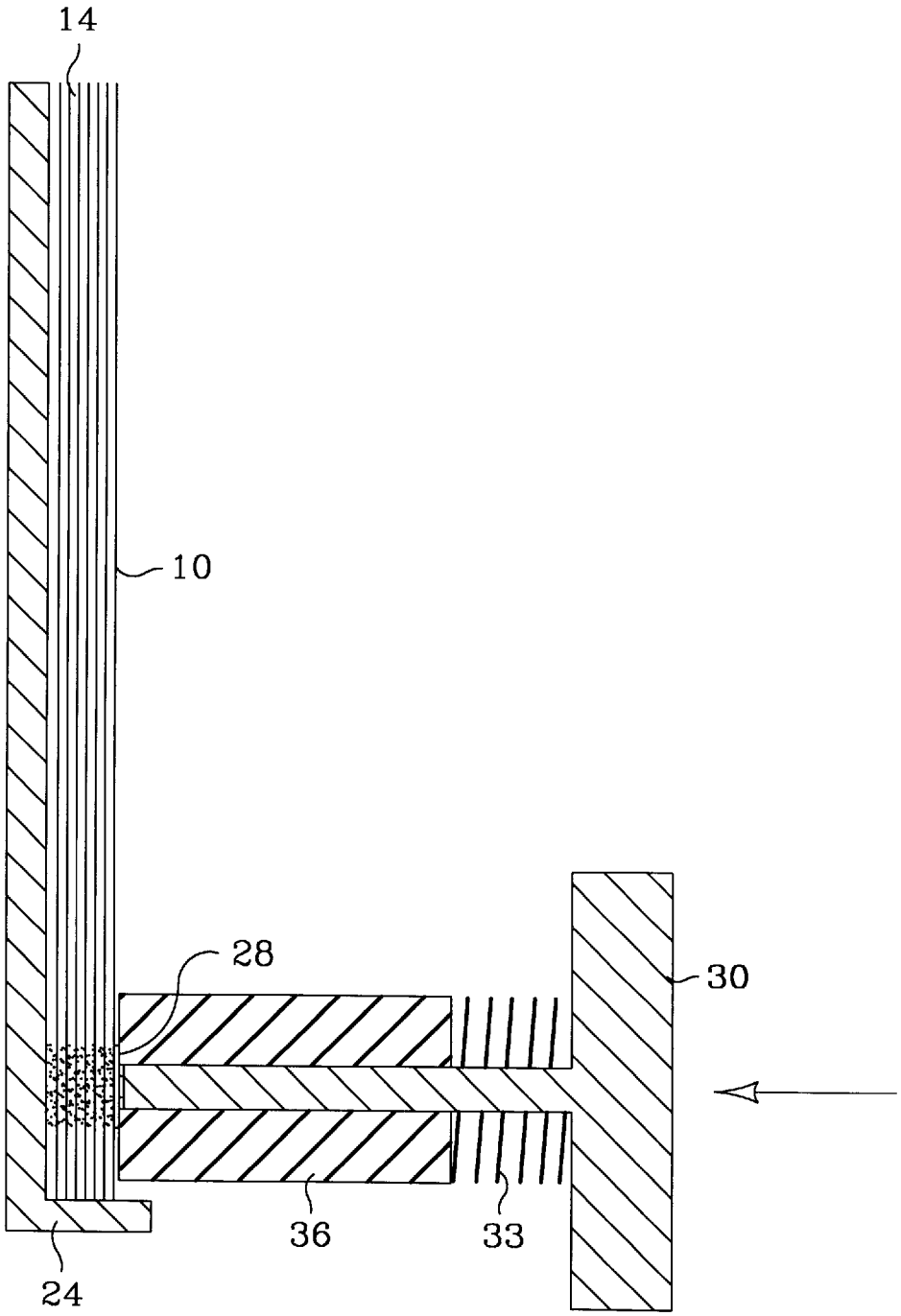

FIGS. 5A–5C illustrate an alternative embodiment in which the press 26 moves horizontally and an electrically dissipative heat sink 30 is used instead of the thermally dissipative heat sink of FIG. 3. Referring to FIGS. 5A–5, sheets 10 accumulate in a vertically oriented tray 26. As heat sink 30 is pressed toward tray 24, heating member 28 is pressed into stack 14 at the urging of springs 33 and slide block 36. As with the first embodiment, the heat and pressure applied to binding region 12 of sheet 10 reactivates the imaging material in region 12. As heat sink 30 is pressed further towards tray 24, it overcomes the resistance of springs 33 and electrically contacts heating control circuit 35. This electrical contact diverts or "short circuits" the electrical current from resistive heating element 34 in heating member 28 to the low resistance heat sink 30 to cool heating member 28. Again, as with the first embodiment, binder 22 is held momentarily in the fully compressed position to maintain pressure on sheet 10 and stack 14 as the heating member 28 cools. The cooling combined with the continuing compression of media sheet 10 and stack 14 allows the reactivated imaging material to cure. Heat sink 30 and the other components are then withdrawn to their starting positions. An electrically dissipative heat sink could also be implemented through a switching circuit selectively connecting heating member 28 to a heat sink remote from binder 22. The electrically dissipative heat sink could be located, for example, in the printer or even in a server or client computer. A remote electrically dissipative heat could be selectively connected to heating member 28 through control switching activated by temperature, sheet registration, timing or any other suitable control mechanism.

Figure 6:
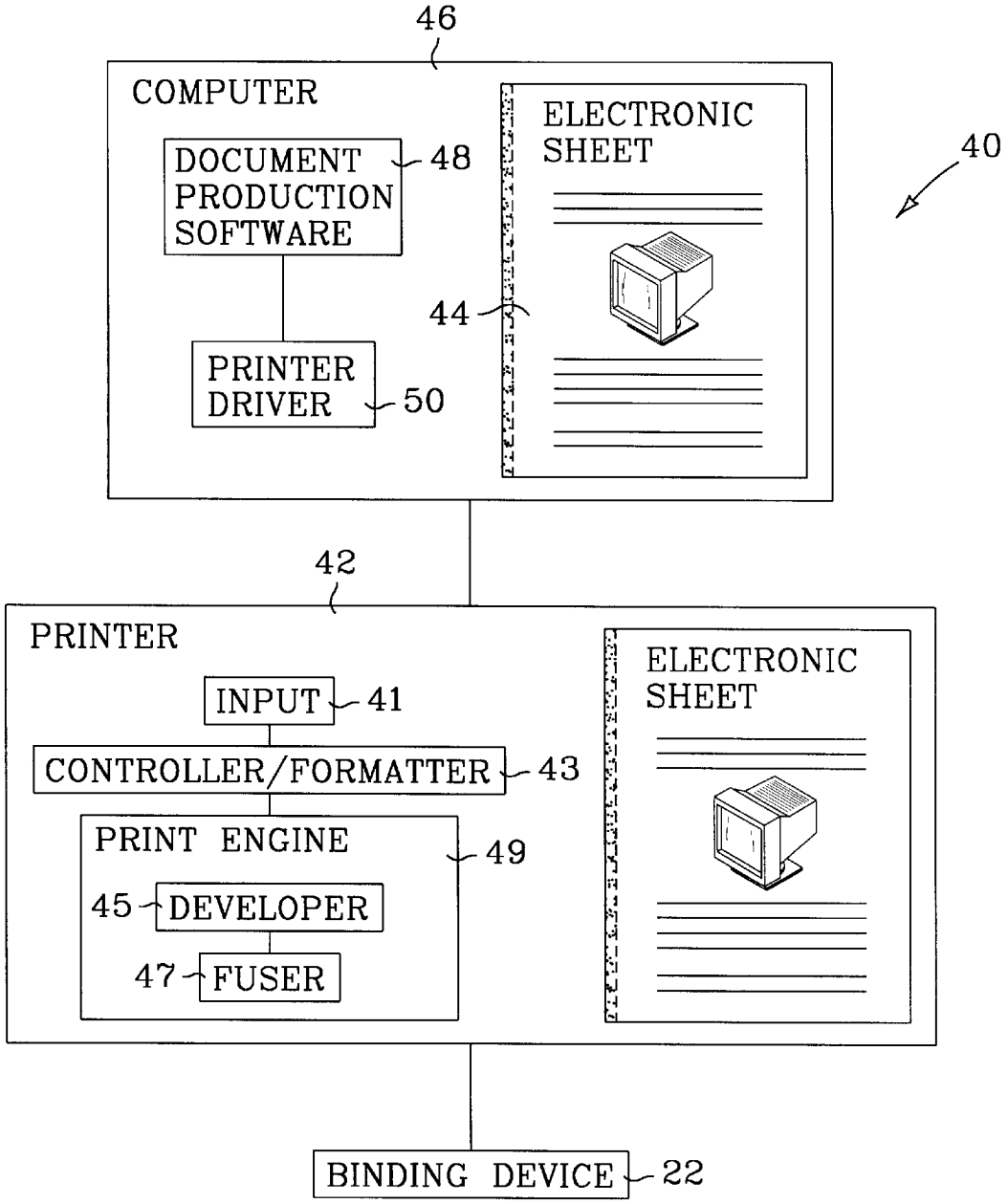
FIG. 6 is a block diagram representing a system for creating, printing and binding a bound document.

Referring now to the block diagram of FIG. 6, a third embodiment of the invention is directed to a system for printing and binding the document, the system generally referenced as 40. In addition to the components of binder 22 described above, system 40 also includes an image forming device 42 such as a laser printer, a copier or a facsimile machine. Image forming device 42 is electronically coupled to a computer 46. Computer 46 may be programmed to generate and/or retrieve a desired print image in electronic form 44 and to transmit electronic document 44 to image forming device 42 instructing image forming device 42 to create the desired print image on media sheet 10. This programming may generally be accomplished by document production software 48 in combination with a printer driver 50. However, system 40 does not necessarily require computer 46. Instead, image forming device 42 may itself perform the functions of computer 46. A digital copier, for example, generates and stores the electronic document itself for subsequent transmission to the print engine where the electronic image is developed into the printed image.

Software 48 electronically creates and/or retrieves desired document 44. Upon receiving a print command, software 48 transmits electronic data representing desired document 44 to printer driver 50. Printer driver 50 compiles the electronic data into a form readable by image forming device 32, generally breaking the electronic data representing desired document 44 into a plurality of separate print images, each representing a page of desired document 44. Software 48 and/or printer driver 50 may also define binding region 12 for each media sheet 10 to be transmitted along with or as part of each print image. Alternatively, binding region 12 may be defined by image forming device 42 or by another suitable mechanism. For each media sheet 10 used to form desired document 44, image forming device 42 applies imaging material in the pattern of the desired print image on one or both sides of media sheet 10. Image forming device 42 may also apply imaging material to defined binding region 12 located on one or both sides of media sheet 10. Image forming device 42 activates the imaging material (fuses the toner if laser toner is used) and outputs media sheet 10 to binder 22.

Image forming device 42 is depicted as a laser printer in FIG. 6. Although it is expected that the binding techniques of the present invention will be most often used with and embodied in electrophotographic printing devices such as the laser printer illustrated in FIG. 6, these techniques could be used with and embodied in various other types of image forming devices. Referring again to FIG. 6, document production software 48 and printer driver 50 transmit data representing the desired print image and binding regions to input 41 on laser printer 42. The data is analyzed in the printer's controller/formatter 43, which typically consists of a microprocessor and related programmable memory and page buffer. Controller/formatter 43 formulates and stores an electronic representation of each page that is to be printed, including the print image and the binding regions. In addition to formatting the data received from input 41, controller/formatter 43 drives and controls the toner development unit 45, fuser 47 and other components of print engine 49.

The present invention has been shown and described with reference to the foregoing exemplary embodiments. It is to be understood, however, that other forms, details, and embodiments may be made without departing from the spirit and scope of the invention which is defined in the following claims.

What is claimed is:

1. An apparatus for binding media sheets having a region of imaging material applied thereto for binding, comprising:

a tray for collecting a plurality of media sheets;

a heating element adjacent to the tray and aligned with a binding region of sheets in the tray;

a first biasing spring interposed between the heating element and the tray such that the first spring biases the heating element away from the tray;

a thermally conductive mass adjacent to the heating element opposite the tray, a thermal mass of the thermally conductive mass being substantially greater than a thermal mass of the heating element;

a second biasing spring interposed between the heating element and the thermally conductive mass such that the second spring biases the thermally conductive mass away from the heating element;

a press coupled to the heating element and the thermally conductive mass, the press operative for each sheet output to the tray to press the thermally conductive mass toward the heating element; and the second biasing spring being stiffer than the first biasing spring such that, as the press presses the thermally conductive mass toward the heating element, the press first overcomes a resistance of the first biasing spring to press the heating element toward the tray against the binding region of any sheets in the tray, and the press then overcomes a resistance of the second biasing spring to bring the thermally conductive mass into contact with the heating element.

* * * * *